United States Patent [19]

Arp

[11] 4,177,614

[45] Dec. 11, 1979

[54] SWIMMING POOL WALL OF RESIN PANELS

[75] Inventor: George F. Arp, Fairport, N.Y.

[73] Assignee: Heldor Associates, Inc., Clifton, N.J.

[21] Appl. No.: 905,640

[22] Filed: May 15, 1978

[51] Int. Cl.[2] ..... E04H 3/18

[52] U.S. Cl. ..... 52/247; 4/172.19; 52/169.7; 52/584; 52/589

[58] Field of Search ..... 52/588, 169.7, 245, 52/246, 247; 4/172.19

[56] References Cited

U.S. PATENT DOCUMENTS

| | | | |
|---|---|---|---|
| 1,100,081 | 6/1914 | Kramer | 52/247 |
| 3,564,791 | 2/1971 | Arp | 4/172.19 |
| 3,585,655 | 6/1971 | Lankheet | 52/169.7 |
| 4,044,514 | 8/1977 | Rubin | 52/169.7 |

FOREIGN PATENT DOCUMENTS

| | | | |
|---|---|---|---|
| 148842 | 10/1952 | Australia | 52/245 |
| 295609 | 4/1932 | Italy | 52/245 |

*Primary Examiner*—John E. Murtagh

*Attorney, Agent, or Firm*—Stonebraker, Shepard & Stephens

[57] ABSTRACT

A swimming pool wall is formed of interconnected panels extending a substantial distance along the pool wall and upward for only part of the height of the wall which is formed of at least 3 tiers of panels. The panels are formed of resin material to have an inward facing wall and flanges extending outward along top, bottom, and end edges. The top and bottom flanges have mating tongues and grooves extending along the length of each of the panels to interlock the tiers together, and the flanges are connected to hold the tongues and grooves together. The flanges at the ends of the panels are interconnected and arranged so that the end joints in one of the tiers are located in central regions of panels in an adjacent tier. A strengthener is fitted into a tongue and groove relationship with the lowermost of the bottom flanges to extend across end edge joints for strengthening the bottom tier. Each of the panels has a predetermined shape so that their substantial length cooperates when the panels are interlocked in tiers to conform the panels accurately to a predetermined configuration of the pool wall. For a cylindrical pool, the panels can be identical with the connected bottom and top flanges forming strong hoops of material extending around the pool wall.

9 Claims, 7 Drawing Figures

SWIMMING POOL WALL OF RESIN PANELS

BACKGROUND OF THE INVENTION

Swimming pool walls have been made of molded resin panels interconnected in several ways to support a pool liner, and structural foam materials have been suggested for pool wall panels. The joining of the panels presents many problems, however; because the assembly can be laborious and the resulting wall can be irregular or weak. A combination of economical manufacture and assembly with strength, uniformity, and reliability in the pool wall has been elusive, and prior art attempts have been substantially less than satisfactory.

The invention involves analysis of the prior art problems of forming pool walls of molded resin panels and proposes a way of configuring panels and assembling a pool wall to achieve both improved economy and improved strength and reliability. The invention aims at overall economy combined with sound and uniform construction of pool walls made of resin panels.

SUMMARY OF THE INVENTION

The inventive swimming pool wall is formed of interconnected panels of resin material, with the panels having an inward facing wall and a flange extending outward from the inward facing wall along top, bottom, and end edges. Each of the panels extends longitudinally of the pool wall for a substantial distance and extends upward for only a portion of the height of the pool wall so that the wall is formed of at least 3 tiers of panels. The flanges at the bottom and top edges of the panels are formed with mating tongues and grooves extending along the length of each panel to interlock the tiers of panels, and the bottom and top flanges are connected together between the tiers of panels to hold the tongue and grooves together in an interlock. The end edge flanges of adjacent panels are also connected together, and end edge joints between panels in one tier are arranged in the central regions of panels in adjacent tiers. A strengthening element is fitted into tongue and groove relationship with the lowermost of the bottom edge flanges to extend across the end edge joints of the lowermost tier. The panels have a predetermined shape so that their substantial lengths cooperate when the panels are interlocked in tiers to conform the panels accurately to a predetermined configuration for the pool wall.

DRAWINGS

DETAILED DESCRIPTION

Figure 1:
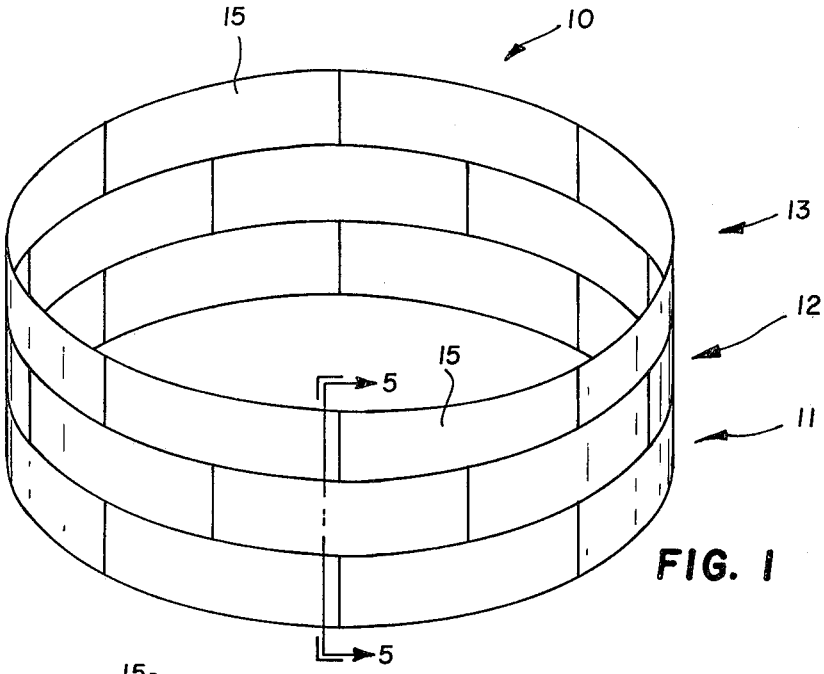
FIG. 1 is a partially schematic, perspective view of a preferred embodiment of the inventive pool wall in a cylindrical form.

The invention is illustrated relative to a cylindrical pool wall 10 as schematically shown in FIG. 1, because a cylindrical pool wall is the simplest to make and is preferred for economy. Pool walls of many other shapes can be made according to the invention, as will be understood by those experienced in the art.

Pool wall 10 is formed of at least 3 tiers 11–13 of relatively elongated panels 15 that are connected end to end in each of the tiers. The tiers are interlocked with each other as explained more fully below to provide an especially strong and easy to assemble pool wall formed of panels that are readily and economically moldable. The way the panels are shaped and interlocked and made relatively long in the direction of the wall also assures that panels of a predetermined shape conform accurately to each other when interlocked in tiers and form a pool wall having a uniform and predetermined configuration without irregularities and without requiring measurement or layout before the panels are assembled.

Figure 2:
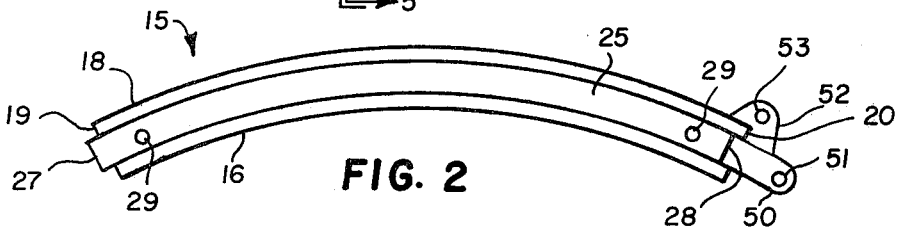
FIG. 2 is a plan view of one of the panels of the pool wall of FIG. 1.
Figure 3:
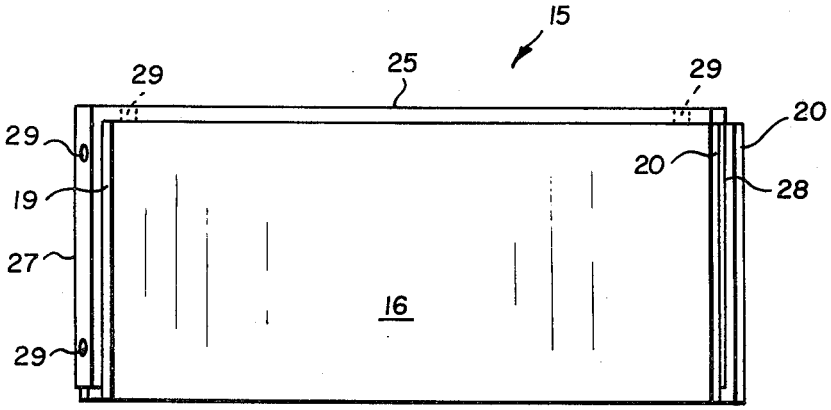
FIG. 3 is an elevational view of the panel of FIG. 2 as viewed from inside relative to the pool wall.
Figure 4:
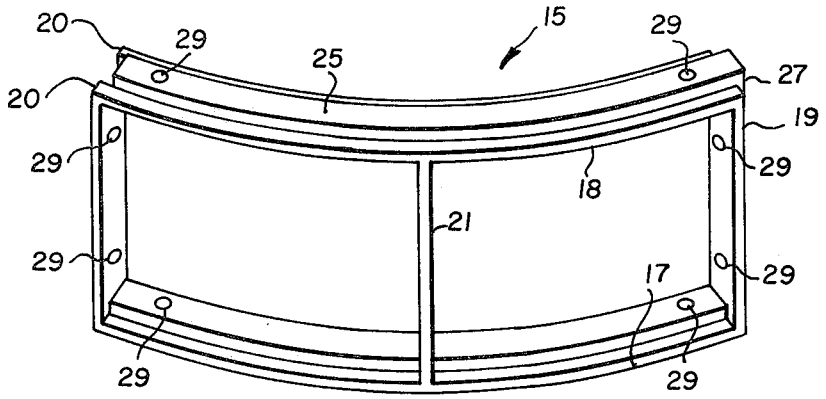
FIG. 4 is a perspective view of the panel of FIG. 2 as viewed from outside relative to the pool wall.
Figure 5:
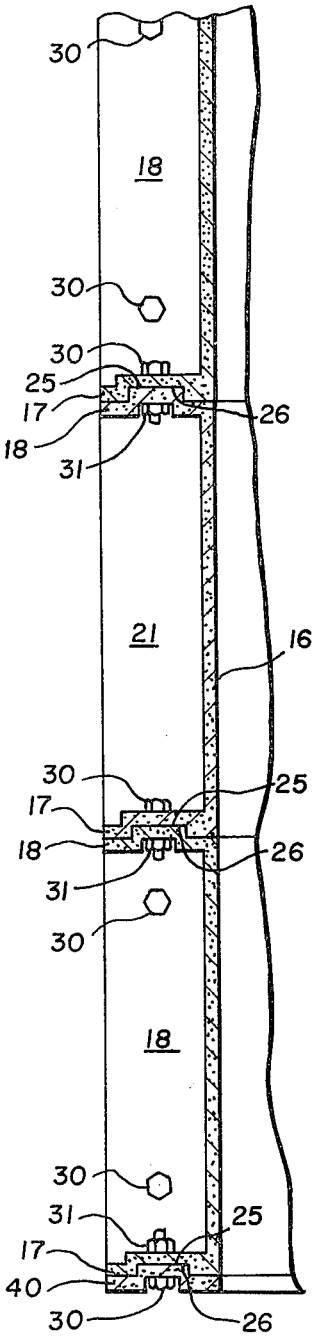
FIG. 5 is an enlarged cross-sectional view of the pool wall of FIG. 1, taken along the line 5—5 thereof.

A preferred configuration for each panel 15 of wall 10 is best shown in FIGS 2–4. For a cylindrical pool wall, each panel 15 is preferably identical to the others for economy in manufacture and assembly. Pool walls having rectangular or other configurations require panels in more than one shape and cooperating braces or other wall strengthening devices, but otherwise pool walls of any shape are adaptable to construction according to the invention. Also, panels in different tiers can have different shapes for facilitating assembly or to provide a coping or liner anchorage or an interconnection with deck panels.

For a cylindrical pool wall 10, each panel 15 preferably extends for at least 36° of arc along the pool wall so that no more than 10 panels are required for a complete cylindrical tier. Depending in part on the pool diameter, lesser numbers of panels per tier can also be used, with each panel extending for a substantial distance along the cylindrical arc of the pool wall. As applied to pool walls of other shapes, panels are preferably given similar proportions to extend longitudinally for a substantial distance along the pool wall and extend vertically for only a portion of the pool wall so that at least 3 tiers of relatively long and narrow panels are used.

Each of the panels 15 has a generally smooth inward facing wall 16 providing support for a pool liner, and flanges and braces extend outward from the inward facing wall 16 to strengthen the panel and facilitate its assembly into wall 10. The flanges include bottom flange 17, top flange 18, and end flanges 19 and 20; and any desired number of braces 21 are preferably spaced along the length of each panel 15 to extend between bottom flange 17 and top flange 18 and engage the outward facing side of wall 16 for strengthening purposes. A single brace 21 is shown for illustrative purposes, and all flanges and braces are configured with a suitable draw to facilitate release from a mold.

Several methods are generally available for forming panels 15 of molded resin material, but the preferred process produces molded structural foam by a method known in the art as reaction injection molding. Two liquid parts of a thermosetting polyurethane polyester resin are injected into a mold under pressure under controlled circumstances that produce a relatively tough outer skin formed against the mold surfaces with a relatively lightweight foamed interior. The density and weight of the finished panel can be controlled by varying the parameters of the molding process; and the resulting panel 15 has a relatively strong and dense outer skin and a foam filled interior, all formed of a thermoset polyurethane polyester resin that is lightweight, strong, and has many advantages for a swimming pool wall. Other processes and other resins can also be used as is generally understood in the resin molding and forming arts to produce panels 15 with sufficient strength and low enough cost to be satisfactory for pool wall construction. Also, different reinforcing materials can be used, and panels can be made as laminations of materials.

Panels 15 are molded with tongues and grooves for interlocking panels and tiers together to form a sturdy and reliable pool wall. Structural foam and other resin materials cannot withstand high stress concentrated in relatively small regions, and a tongue and groove arrangement provides a sturdy and practical interlock extending for substantial distances around pool wall 10. The preferred way of doing this is with a tongue 25 extending along the full length of top flange 18 of each panel 15 and a mating groove 26 extending along the full length of bottom flange 17 of each panel 15. The longitudinally extending tongues 25 and grooves 26 can also be reversed, but it is preferred to have tongues 25 extend upward and grooves 26 face downward as the wall is assembled. End flanges 19 and 20 are also preferably provided with respective tongues 27 and grooves 28 for a strong interconnection of the panel ends.

Holes 29 are either molded or formed in flanges 17–20 for interconnecting the flanges of panels 15 as the pool wall is assembled. An easy and preferred way of doing this is with bolts 30 and nuts 31 as shown in FIG. 4, and these are also preferably formed of molded resin material both for economy and to have a strength compatible with the resin material forming panel 15. In addition, wrenches that are preferably formed of molded resin material can be used to tighten resin nuts 31 on resin bolts 30 for interconnecting the flanges of panels 15 to help prevent placing any undue stress on the connectors. Fasteners or connectors other than bolts and nuts can also be used, and materials other than molded resin can be used for fastening flanges together. The tongue and groove interlock provides structural strength for the wall, and the fasteners or connectors between panels are relied on merely to keep the tongue and groove interlocks firmly engaged with each other.

It is preferred according to the invention to strengthen the lowermost bottom flange 17 of the bottom tier of panels by fitting a strengthening element 40 into a tongue and groove relationship with lowermost flange 17. In one preferred way of constructing wall 10, lowermost flange 17 has a groove 26, and strengthening element 40 has the same general configuration as an upper flange 18 with a tongue 26 that fits groove 25. Strengthening element 40 can extend for a full circle around the bottom of wall 10 if desired or can be formed as a number of segments equalling the number of end joints in bottom tier 11 and arranged to span each end joint between adjacent panels 15 and bottom tier 11. Bolts 30 and nuts 31 can be used to secure strengthening element 40 to lowermost flange 17, or other fasteners can be used. One alternative is to have threaded holes in strengthening element 40 fitting holes formed in lowermost flange 17 so that screws can extend through lowermost flange 17 and be threaded into strengthening element 40. Another possibility is stakes driven through lowermost flange 17 and strengthening element 40 and into the ground below the bottom of wall 10, not only to strengthen the vertical end joints between panels 15 and lower tier 11 but also to help anchor the bottom of pool wall 10 to the ground. Other possibilities that are known in the art include pouring a concrete anchoring wall around the outside of the bottom edge of lower tier 11.

Figure 6:
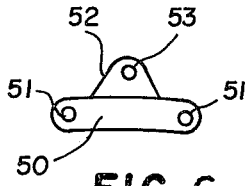
FIG. 6 is a plan view of a preferred embodiment of a strengthening element for positioning under the lowermost bottom flange of the lowest tier of panels.
Figure 7:
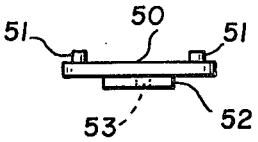
FIG. 7 is a side elevational view of the strengthening element of FIG. 6.

Another preferred strengthening element for the bottom tier of the pool wall is shown in FIGS. 6 and 7. It is preferably applied to a grooved bottom flange 17 at the bottom of the lowest tier and is formed as a tongue-shaped element 50 that snugly fits in bottom groove 26 and spans the end edge joints between panels 15. Tongue-shaped element 50 preferably has a pair of projections 51 positioned to extend into holes 29 formed in lowermost bottom flange 17 to interlock the strengthener with the lower tier of panels 15 in a quick and easy assembly. Projections 51 locate the strengthening element securely in place relative to the joined panels to maintain a tongue and groove interlock spanning the end edge joints of the bottom tier. The strengthener also has a side projection 52 arranged to extend outward from the pool wall in the region of each of the end edge joints between bottom tier panels, and side projection 52 has a hole or puncturable recess 53 through which a stake can be conveniently driven for helping to anchor the bottom tier of the pool wall in place. Projection 52 with its stake receiving opening 53 provides a more convenient way of staking the bottom of the pool wall in place.

The tongue and groove interlock between panels 15 forms an especially strong wall by doubling up and interconnecting flanges 17 and 18 to form hoops of material extending around wall 10. Each of these hoops includes a strong tongue and groove interlock extending all the way around the pool to form strengthening bands where the tiers are joined together. Additional strength is achieved by staggering the end joints between panels 15 in adjacent tiers so that each end joint is arranged in a mid-region of a panel in an adjacent tier. Panels then extend across the end edge joints of adjacent tiers, and the continuous tongue and groove joints extending for the full length of panels 15 cooperate for greatly increasing the strength of the staggered end joints.

Pool wall 10 is assembled by either laying down or securing strengthening elements 40 or 50 to the lowermost flange of bottom tier 11 and arranging panels in end to end relationship around each tier to build the wall from bottom to top for 3 or more tiers. Flanges 17–20 of panels 15 are interconnected to secure the tongue and groove interlocks either as the assembly proceeds or after all the panels are positioned in place. The work proceeds quickly, and the interlocking connections between panels results in a very sturdy wall.

Each of the panels has a predetermined shape fitting the configuration of the pool wall, and the substantially long extent of each panel along the pool wall insures accurate alignment of all panels in conformity with the desired wall shape. This eliminates any need for measurement or layout as panels are interconnected in assembling the pool wall, because any misalignment tendency in one tier is automatically corrected by panels in adjacent tiers that span the end edge joints and use their long length in cooperation with their tongue and groove interlocks to bring all panels into accurate conformity with the desired pool wall shape. This elminates irregular shaped walls and tendencies to form scalloped shapes or polygonal shapes where smooth curves are intended. Moreover, interlocked panels according to the invention can be readily moved for accurate positioning of the pool wall.

The relatively long narrow configuration preferred for panels 15 is compatible with molding processes for forming panels of structural foam or other resin forming techniques. The tooling costs for long and narrow panels are moderate, and the size and shape of the preferred molded panels facilitates shipping and handling. Individual panels are easily lifted, moved, and positioned by a single worker; and the panel configuration allows assembly of a pool without marking out a circle or other shape, because the long interlocking panels prevent deviation from the intended shape of the assembled pool wall. All of these features cooperate to give the inventive pool wall construction both economic and structural advantages.

I claim:

1. A swimming pool wall formed of a plurality of interconnected panels of resin material, each of said panels having an inward facing wall and a flange extending outward from said inward facing wall along top, bottom, and end edges of said panels, and said pool wall comprising:

a. each of said panels extending longitudinally of said pool wall for a substantial distance and extending upward for only a portion of the height of said pool wall with said pool wall being formed of at least three tiers of said panels;

b. said flanges at said bottom and top edges of said panels being formed with mating tongues and grooves extending along the length of each of said panels to interlock said tiers of said panels;

c. means for connecting together said flanges at said bottom and top edges between said tiers of said panels to hold said tongues and grooves together in said interlock;

d. means for connecting together said flanges at said end edges of longitudinally adjacent ones of said panels, so that end edge joints between said panels in one of said tiers are arranged in a central region of one of said panels in an adjacent tier;

e. means for fitting into tongue and groove relationship with the lowermost of said bottom edge flanges and extending across said end edge joints of the lowermost one of said tiers; and f. each of said panels having a predetermined shape so that said substantial longitudinal extent of said panels in said interlocked tiers cooperates to conform each of said panels accurately to a predetermined configuration of said pool wall.

2. The pool wall of claim 1 including resin fasteners for connecting said flanges together.

3. The pool wall of claim 1 wherein said pool wall is generally cylindrical, and each of said panels is arcuate and extends for a minimum of 36° of arc.

4. The pool wall of claim 1 wherein said tongues face upward and said grooves face downward.

5. The pool wall of claim 1 wherein said means for fitting said lowermost bottom edge flange comprises a plurality of lengths of material shaped like one of said top edge flanges and positioned under said lowermost bottom edge flange.

6. The pool wall of claim 1 wherein said lowermost bottom flanges are grooved and said means for fitting said lowermost bottom flanges comprises a plurality of lengths of tongue-shaped material positioned under said lowermost bottom flanges.

7. The pool wall of claim 6 wherein said flanges of said panels are formed with apertures for interconnecting said flanges, and said means for fitting said lowermost bottom flanges are formed with projections arranged to fit into said apertures in said lowermost bottom flanges.

8. The pool wall of claim 7 wherein said pool wall is generally cylindrical, and each of said panels is arcuate and extends for a minimum of 36° of arc.

9. The pool wall of claim 1 wherein said flanges of said panels are formed with apertures and including resin bolts and nuts for extending through said apertures and connecting said flanges together.

* * * * *